US005304982A

United States Patent [19]

Cordery

[11] Patent Number: 5,304,982

[45] Date of Patent: Apr. 19, 1994

[54] APPARATUS AND METHOD FOR DETECTING MAGNETIC ELECTRONIC ARTICLE SURVEILLANCE MARKERS

[75] Inventor: Robert A. Cordery, Danbury, Conn.

[73] Assignee: Pitney Bowes Inc., Stamford, Conn.

[21] Appl. No.: 940,275

[22] Filed: Sep. 3, 1992

[51] Int. Cl.[5] ..... G08B 13/24

[52] U.S. Cl. ..... 340/551; 340/572

[58] Field of Search ..... 340/551, 572

[56] References Cited

U.S. PATENT DOCUMENTS

| | | | |
|---|---|---|---|
| 3,990,065 | 11/1976 | Purinton et al. | 340/572 |
| 4,356,477 | 10/1982 | Vandebult | 340/572 |
| 4,710,752 | 12/1987 | Cordery | 340/572 |
| 5,005,001 | 4/1991 | Cordery | 340/551 |
| 5,023,598 | 6/1991 | Zemlok et al. | 340/572 |

*Primary Examiner*—Glen R. Swann, III

*Attorney, Agent, or Firm*—Peter Vrahotes; Melvin J. Scolnick

[57] ABSTRACT

A dual frequency field is generated to produce an interrogation zone wherein the higher frequency is substantially higher than the lower frequency. The signal generated by the magnetic marker is detected, filtered and amplified. Time windows are selected at the expected pulse locations of a signal. The signals detected at the time windows are multiplied by a window function. The product resulting therefrom is averaged to produce a demodulated signal and the presence of a marker in the interrogation zone is determined by detecting the demodulated signal at the lower frequency of the dual frequency interrogation zone.

4 Claims, 3 Drawing Sheets

APPARATUS AND METHOD FOR DETECTING MAGNETIC ELECTRONIC ARTICLE SURVEILLANCE MARKERS

BACKGROUND OF THE INVENTION

1. Field of the Invention

In electronic article surveillance (EAS) systems, articles being protected are tagged with a tag containing an electronically detectable device which is referred to as a marker. Typically, a sweep frequency interrogation transmitter whose frequency is swept through a resident frequency of the tag includes a transmitting antenna located near an exit of a protected area. A receiving antenna is located near the transmitting antenna and forms a passage-way with the transmitting antenna through which someone exiting the protecting area must pass. The receiving antenna is coupled to a receiver that detects the signal radiated by the marker whenever the transmitter frequency passes through the resident frequency of the marker. There are two types of EAS systems of primary use commercially. Radio frequency (RF) systems and magnet systems. The instant invention has particular use in a magnetic EAS system wherein a magnetic field is generated at a fixed frequency. A signal is generated when the magnetic field causes the magnetization of a marker to switch. This occurs near zero field amplitude.

2. Description of the Related Art

Although there are many EAS systems that work satisfactorily well, all these systems face the problem of distinguishing a signal emitted from the EAS marker from background noise. For example, in U.S. Pat. No. 5,023,598, detection is achieved by the use of averaging techniques of a plurality of sweeps wherein peaks above a defined level are stored in a persistent table. A symmetry test is made on the peaks and if the peaks are persistent and symmetrical, the presence of a marker is indicated. Although this system works well, it is primarily directed to radio frequency systems that detect the presence of a resonant tank circuit. U.S. Pat. No. 5,005,001 describes an EAS system that has a signal generator for generating a magnetic field which includes an arrangement for generating a non-rotating field at a first frequency and a rotating field at a second frequency that is lower than the the first frequency. This system is designed for the purpose of detecting magnetic markers and represents an advancement in the constant attempt to eliminate background noise; nevertheless, it would be advantageous to reach a higher level of efficiency for detecting magnetic markers.

SUMMARY OF THE INVENTION

The instant invention provides a system and method for detecting the presence of a ferromagnetic marker in an interrogation zone. The system includes first and second generating means for generating first and second magnetic fields, respectively, at first and second frequencies. The second frequency is substantially lower than the first frequency. Such a system and method is shown and described in U.S. Pat. No. 4,710,752. In order to enhance the detection of a magnetic marker in the field and reduce the number of false readings, a window demodulation scheme is used. This is achieved by selecting time windows at the expected pulse location of the marker, multiplying the received signal by a window function multiplier and averaging the product thereof over each time window to produce a demodulated signal. If the demodulated signal is detectable at the second frequency of the dual frequency field, this indicates the presence of a magnetic marker in the interrogation zone.

DETAILED DESCRIPTION OF THE PREFERRED EMBODIMENT

Figure 1:
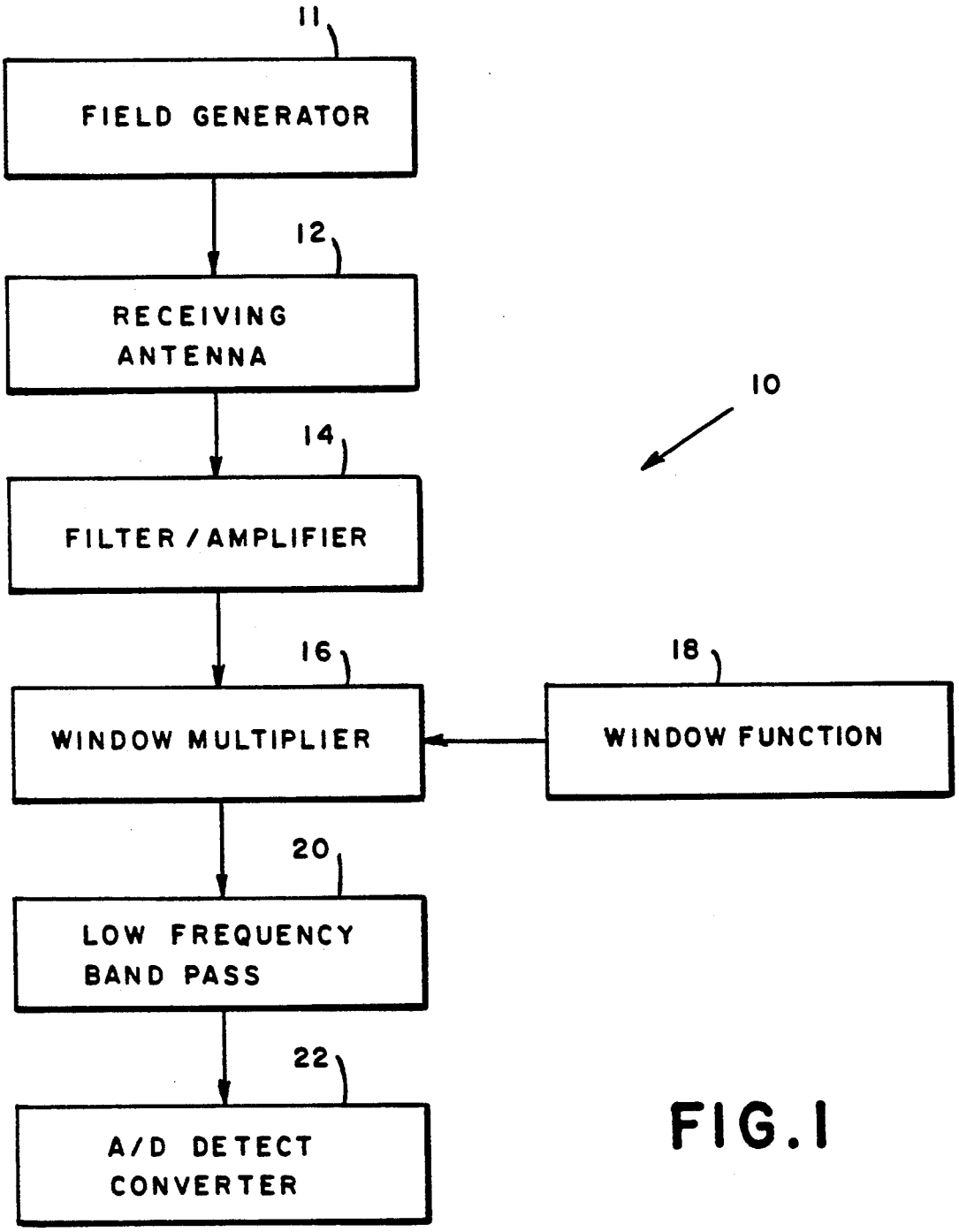
FIG 1 is a block diagram showing the components of the system used for carrying out the invention.
Figure 2:
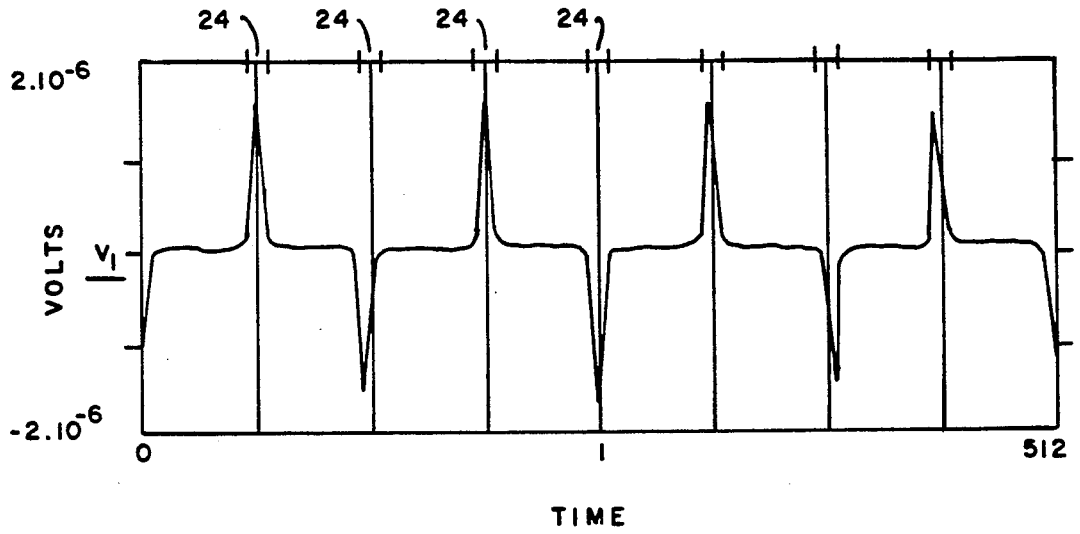
FIG. 2 is a graph showing the signal emitted at the antenna in response to detecting a magnetic marker.

With reference to FIG. 1, an electronic article surveillance (EAS) system is shown generally at 10, in which the instant invention can be practiced. The surveillance system 10 includes a field generating unit 11 capable of producing a dual frequency interrogation zone. Such a system is shown and described in U.S. Pat. No. 4,710,752. Such a system has a high frequency field, for example greater than 3 kHz and a second frequency field, for example less than 750 Hz. The dual frequency system results in a time modulation of the signal that is produced by a marker located within the interrogation zone and detected by a receiving antenna 12. The signal thus produced by a marker is indicated in FIG. 2 that shows the voltage produced during a period 512 time units. Each time unit is subdivided into eight windows 24, which are located at the expected intervals where a signal is to be produced. By window is meant the time portion the signal is observed at which a pulse is expected.

Figure 3:
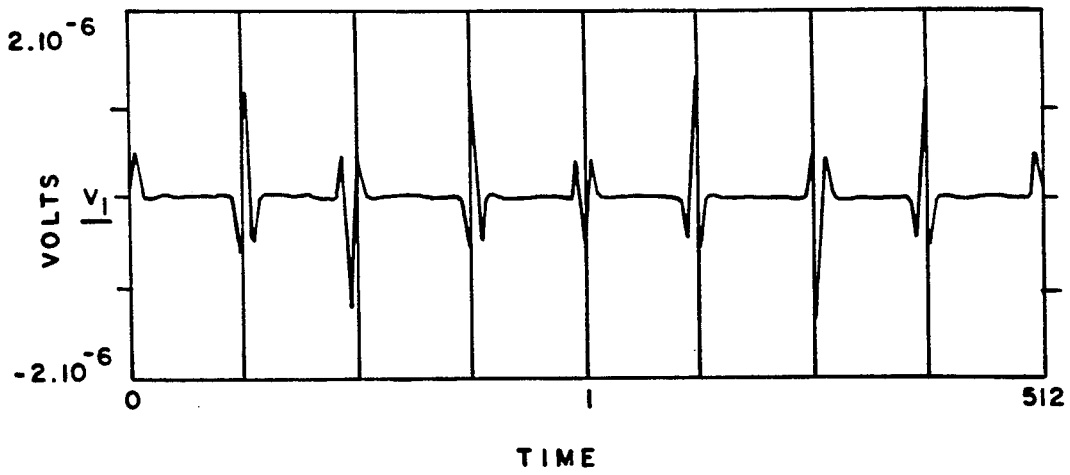
FIG. 3 is a graph of the signal of FIG. 2 after being filtered.

In communication with the receiving antenna 12 is a filter/amplifier unit which filters the signals received to remove noise and thereafter amplifies the filtered signal. Such filter/amplifiers are commercially available, as for example from Linear Technologies, Inc. The filter/amplifier 14 must be customized for the particular application for which it is used by adjusting the input impedance of the amplifier and the frequency response of the filter. The filter response was designed to match the incoming signal by correlating the capacitors and resistors of the filter/amplifier. The signal output by filter/amplifier 14 is shown in FIG. 3.

Figure 4:
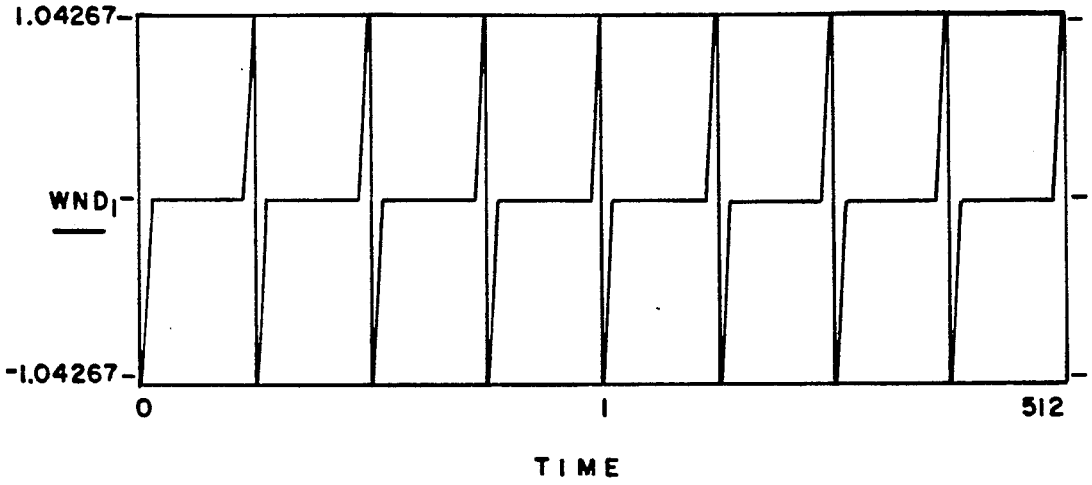
FIG. 4 is a graph of the window multiplier function.

In communication with the filter/amplifier 14 is a window multiplier 16 that receives a window function from a window function generator 18. The latter can be part of the window multiplier 16, but is shown separately for illustration purposes. The output of the window multiplier function 18 is shown in FIG. 4 and is a demodulating function used to detect a signal in a time window 24. In addition, a time derivation of the pulse signal can be averaged over the expected position of the signal in time to account for the earth's magnetic field.

The window multiplier function is designed to detect the modulation of the time of the pulse relative to the period of the high frequency field. The modulation is caused by the low frequency field. The ideal multiplier function to detect small time shifts of a signal is the time derivative of the filtered signal. One complication occurs because the exact time and width of the pulse depends on the amplitude and direction of the applied field at the marker, and on the orientation of the marker relative to the earth's magnetic field. Averaging the time derivative of the filtered, amplified pulse over the expected range of pulses produces a good window multiplier function. The window function defined above compensates for the average effect of the earth's field. The overall performance of the system can be improved slightly by optimizing the detector for tag positions which produce relatively weak signals.

Figure 5:
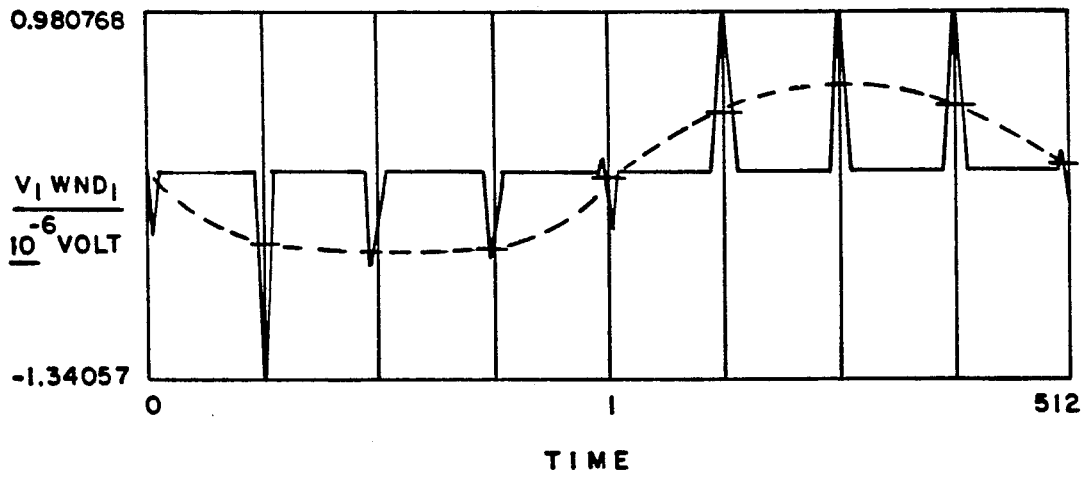
FIG. 5 is a graph of the product of the signal times the window multiplier function.

The filtered/amplified signal is multiplied by the window function multiplier to produce a signal shown in FIG. 5. The peaks are then averaged, which is accomplished by a capacitor within a low frequency bypass unit 20, that integrates the product of the filtered-/amplified signal times the window function multiplier to give an average of the pulse over each window 24. These averages are then fashioned into a signal, shown in dotted lines in FIG. 5, and the signal at 750 Hz after averaging is sought. If a signal much larger than the background is detected, this indicates the presence of a marker.

Various markers were used with the above described apparatus to determine if they can be detected. Such markers included those using soft magnetic fibrous material as described in U.S. Pat. No. 5,003,291, windowed ferromagnetic ribbon as described in U.S. Pat. No. 4,849,736, linear ferromagnetic ribbon as described in U.S. Pat. No. 4,298,862 and ferromagnetic wire as described in U.S. Pat. No. 4,568,921. Markers with each of these different types of ferromagnetic materials were placed individually into a dual frequency interrogation zone with the frequencies at 3 kHz and 750 Hz. The signal emitted from a marker was filtered and amplified. Afterwards which such filtered and amplified signal was multiplied by a window function multiplier. The product of this signal was then averaged over the windows. A signal was sought at 750 Hz and in each case this signal was found to be sufficiently strong to indicate the presence of a marker.

A signal is sought at 750 Hz because it is advantageous to detect the weaker marker signal as opposed to a signal at 3 kHz. Detecting the stronger signal is little problem and by detecting the weaker signal, one is assured of reliable detection.

In an alternative embodiment, two window multipliers are used that are 90° out of phase with one another to separately multiply the filtered/amplified signal to produce two signals. This eliminates the need to average the time derivative of the pulse and provides more information about the signal because independent of the position of the pulses within the time window, at least one of the two window multipliers will produce a signal within a time window.

Thus, it has been shown that the inventive system and method yields the ability to more reliably detect soft ferromagnetic markers regardless of the form of the soft ferromagnetic material.

The above embodiments have been given by way of illustration only, and other embodiments of the instant invention will be apparent to those skilled in the art from consideration of the detailed description. Accordingly, limitations on the instant invention are to be found only in the accompanying claims.

What is claimed is:

1. A method for detecting the presence of a soft ferromagnetic marker in a dual frequency interrogation zone, the steps comprising:
   - receiving a signal from the interrogation zone,
   - filtering the signal to remove noise, and limit the signal bandwidth,
   - amplifying the filtered signal,
   - deriving a window function based upon the derivative of the filtered signal,
   - selecting time windows at the expected pulse locations of the signal and multiplying the filtered/amplified signal at the selected time windows by the window function,
   - averaging the product of the filtered/amplified signal times the window function over each time window to produce a demodulated signal, and
   - determining the presence of a marker in the interrogation zone by detecting the demodulated signal at the lower frequency of the dual frequency interrogation zone.

2. The method of claim 1 further including the further step of adjusting the position of the time windows to compensate for the earth's magnetic field.

3. The method of claim 1 further including the steps of generating a second window function that is 90° out of phase with the first window function and multiplying the filtered amplified signal by both window functions individually to produce two signals.

4. A system for detecting the presence of a soft ferromagnetic marker in a dual frequency interrogation zone, comprising:
   - at least one generating coil for generating a dual frequency field having a high frequency signal and a low frequency signal, in an interrogation zone,
   - a detection coil for detecting signals emitted by a marker located within the interrogation zone,
   - a band pass filter in communication with the detection coil for filtering noise from the marker signal,
   - an amplifier in communication with the band pass filter for amplifying the filter signal,
   - a window multiplier in communication with the amplifier for multiplying the amplified signal by a window function, and
   - a signal generating device to generate a demodulated signal at the lower frequency of the dual frequency field.

* * * * *